US005400508A

United States Patent [19]

Deubler

[11] Patent Number: 5,400,508

[45] Date of Patent: Mar. 28, 1995

[54] SHAVING APPARATUS HAVING A DUST SEAL

[75] Inventor: Hans Deubler, Klagenfurt, Austria

[73] Assignee: U.S. Philips Corporation, New York, N.Y.

[21] Appl. No.: 93,244

[22] Filed: Jul. 16, 1993

[30] Foreign Application Priority Data

Jul. 24, 1992 [AT] Austria ..... 1518/92

[51] Int. Cl.[6] ..... B26B 19/02; B26B 19/26; B26B 19/38

[52] U.S. Cl. ..... 30/43.92; 30/43.3; 30/43.9

[58] Field of Search ..... 30/43, 43.3, 43.8, 43.91, 30/43.9, 43.92

[56] References Cited

U.S. PATENT DOCUMENTS 4,719,698 1/1988 Ninomiya et al. ..... 30/43.92 X

FOREIGN PATENT DOCUMENTS 0480499 4/1992 European Pat. Off. .
1065298 9/1959 Germany .
3415124 10/1985 Germany .

*Primary Examiner*—Richard K. Seidel
*Assistant Examiner*—Raymond D. Woods
*Attorney, Agent, or Firm*—Ernestine C. Bartlett

[57] ABSTRACT

A shaving apparatus (1) comprising a shaving head (10) with a foil-like upper cutter (71) and a lower cutter (73), which engages with the upper cutter and is drivable by a block-shaped drive member (75), has a hood-like and trough-like dust seal (107) with four side walls (108, 109, 110, 111) connected to the drive member (75). The dust seal (107) has a shoulder (126) which extends over all four side walls (108, 109, 110, 111), and the shoulder (126) has an undulating shape, preferably a sawtooth shape, at least at the two larger side walls (108, 109).

4 Claims, 3 Drawing Sheets

SHAVING APPARATUS HAVING A DUST SEAL

BACKGROUND OF THE INVENTION

The invention relates to a shaving apparatus comprising a shaving head having a foil-like upper cutter and a lower cutter engaging therewith, which cutters both have a shaving area which is arched relative to an axis, a drive means for the lower cutter, which drive means is drivable by a motor and comprises a block-shaped drive member adapted to impart to the lower cutter at least a movement parallel to the direction of the axis, and a dust seal formed of an elastic material, which dust seal has a hood-like and trough-like shape, is arranged around the block-shaped drive member and comprises four side walls and an end portion connecting the dust seal to the drive member, which end portion bounds the four side walls at their ends facing the lower cutter and has an opening for the passage of a driving portion of the drive member, and a peripheral portion with which the dust seal engages against a stationary zone of the housing, which peripheral portion bounds the four side walls at their ends which are remote from the lower cutter.

A shaving apparatus of the type defined in the opening paragraph is known, for example, from EP 0,480,499 A1. In this known shaving apparatus the hood-like and trough-like dust seal has side walls of substantially continuous and substantially flat shape. It has been found that when the lower cutter is driven the dust seal of this construction, which is then moved along, performs movements of comparatively large amplitude at the location of and directed transversely to its large side walls, which extend parallel to the axis, and consequently acts substantially as a loudspeaker diaphragm, so that the dust seal produces a comparatively loud noise. This is annoying and for this reason such a construction of a dust seal is found to be unsatisfactory in practice.

SUMMARY OF THE INVENTION

It is an object of the invention to preclude the above problems and to construct a dust seal in a shaving apparatus of the type defined in the opening paragraph in such a manner that hardly any or only a minimal noise is produced. In order to achieve this object the invention is characterized in that the dust seal has a shoulder which extends over all four side walls, and the shoulder has an undulating shape at least at the two facing side walls which extend parallel to the direction of the axis. As a result, these wall portions do not act as a loudspeaker diaphragm, so that such a dust seal in a shaving apparatus in accordance with the invention produces hardly any or at the most a very small amount of noise which is not annoying. Such a shaving apparatus is consequently very silent in operation, which is regarded as pleasant and advantageous by a user of the apparatus.

It is to be noted that a shaving apparatus having a dust seal is known from DE 34 15 124 C2, in which at the location of the dust seal the drive means does not comprise a block-shaped drive member but a pin-shaped drive member and in which the dust seal does not have a hood-like and trough-like shape but a rotationally symmetrical shape resembling a truncated cone. This dust seal also has a continuous shoulder. However, this shoulder extends at the same level along the entire circumference. Conversely, the shoulder of the hood-like and trough-like dust seal of a shaving apparatus in accordance with the invention has an undulating shape at least at the two facing side walls of the dust seal which extend parallel to the axis. The afore-mentioned advantage of a substantially negligible very low noise production by the dust seal in a shaving apparatus having such a hood-like and trough-like dust seal is obtained only by the provision of such an undulating shape in such a shaving apparatus.

In its undulating areas the shoulder may have, for example, a substantially sinusoidal shape. In practice it is found to be particularly advantageous if the shoulder is sawtooth-shaped in its undulating areas. In practice, it is found that with such a sawtooth shape of the shoulder a dust seal in such a shaving apparatus produces particularly little noise.

It is also found to be particularly advantageous if the peripheral portion of the dust seal engages a step which is formed inside the housing and which is open towards the shaving head, and the peripheral portion of the dust seal presses against an area of the shaving head with a peripheral zone which is free from the step. In this way the peripheral area of the dust seal is used not only for securing the dust seal but also as a damping element, which prevents mechanical vibrations between the shaving head and the housing of the shaving apparatus and hence an undesirable noise production.

DETAILED DESCRIPTION OF THE INVENTION

Figure 1:
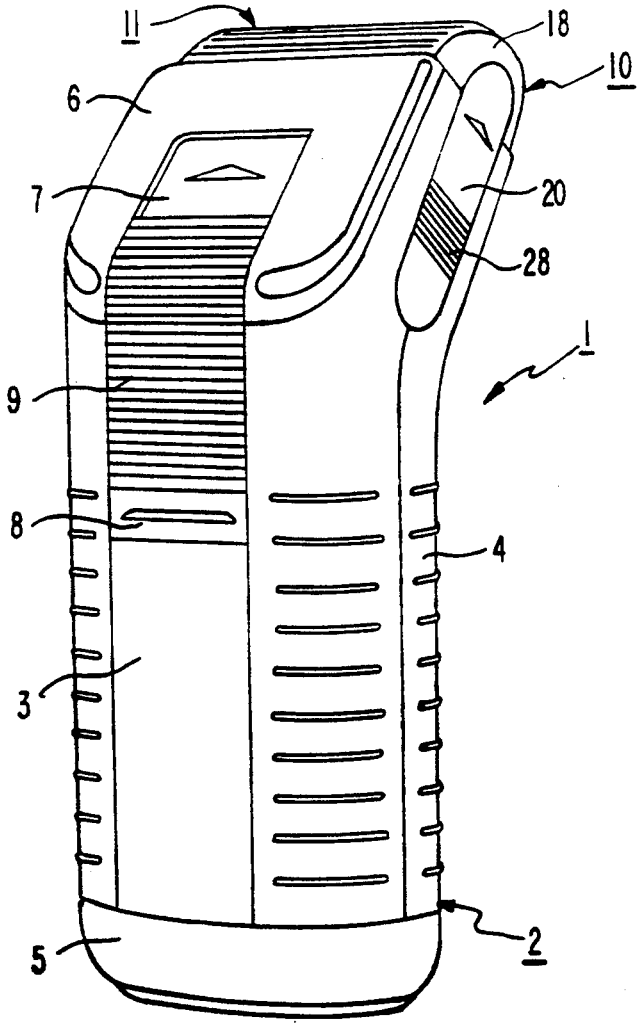
FIG. 1 is an oblique view of a shaving apparatus with a shaving head in accordance with the invention.

The invention will now be described in greater detail with reference to the figures of the drawing.

FIG. 1 shows a shaving apparatus 1 having a housing 2 comprising two interconnected housing halves 3 and 4 completed by a trough-shaped housing section 5 at the bottom. A trimmer 8, not shown in FIG. 1, is arranged at the location of the housing half 3 and is movable between a rest position, in which it is retracted into the shaving apparatus 1, and an operating position, in which it is slid out of the shaving apparatus 1, said trimmer being concealed by a cover plate 6 in the rest position so that only a cutter support 7 of the trimmer is partly visible. To move the trimmer, not shown in FIG. 1, the shaving apparatus 1 has an actuating element 8, which is connected to the cutter support 7 of the trimmer by a shutter-like flexible coupling member 9.

A shaving head 10 is mounted on the housing 2 of the shaving apparatus 1 and is detachably connected to the housing 2. The shaving head 10 has a foil-like upper cutter in the form of a shear foil, which can also be covered by means of a shutter-like cover 11, which is movable substantially parallel to the main wall of the housing half 4 between a cover position shown in FIG. 1, in which it covers the foil-like upper cutter, and an open position (not shown), in which it exposes the shear foil to permit shaving.

Figure 5:
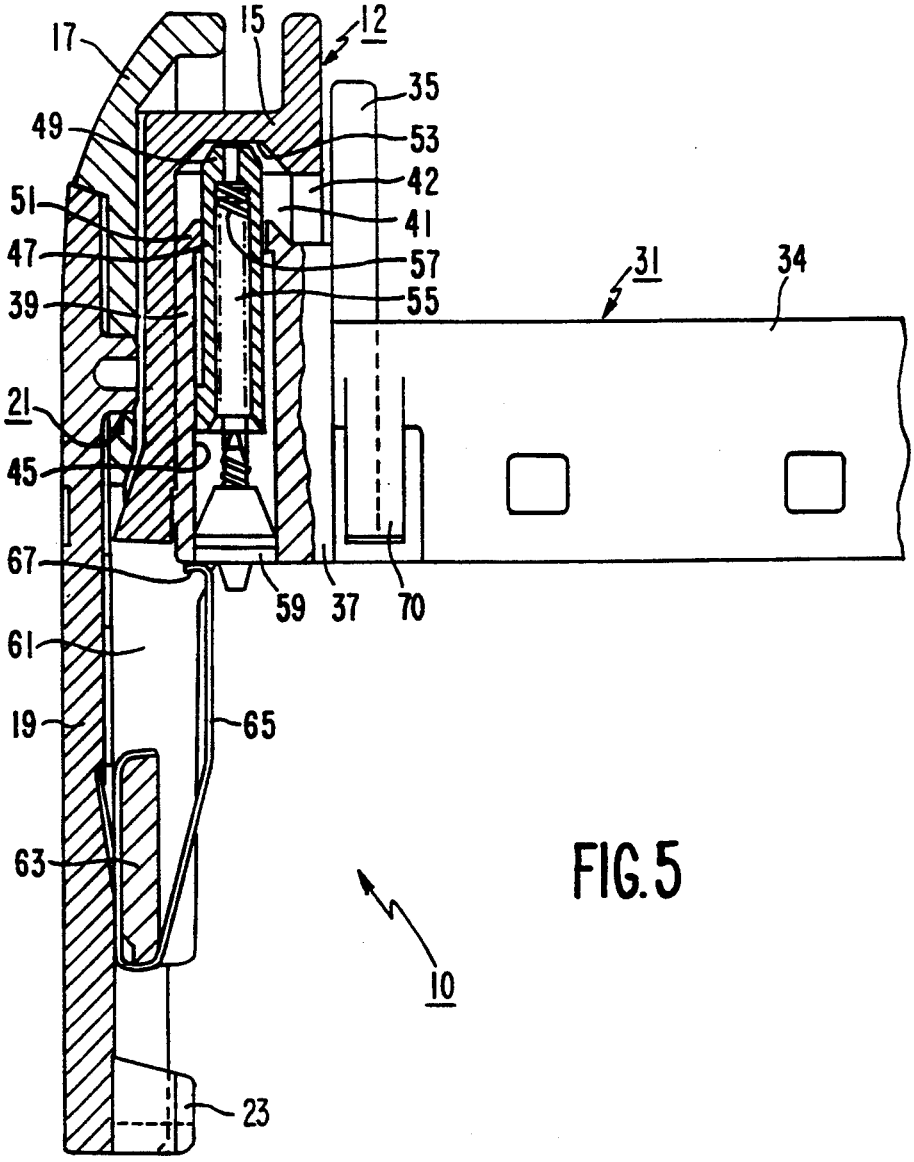
FIG. 5, in the same way as FIG. 2 but to an enlarged scale in comparison with FIG. 2, shows a part of the shaving head of the shaving apparatus shown in FIGS. 1, 2 and 3, without the shear foil being attached to the foil frame.

The shaving head 10 of the shaving apparatus 1 will now be described with reference to FIGS. 2, 3 and 5. The shaving head 10 comprises a metal shaving-head frame 12 formed by a zinc die-casting comprising a first longitudinal side wall 13, a second longitudinal side wall 14, a first transverse side wall 15 and a second transverse side wall 16. A first chromium-plated plastics part 17 and 18, respectively, and a second plastics part 19 and 20, respectively, are connected to the shaving-head frame 12 at the location of the two transverse side walls 15 and 16 in that the chromium-plated plastics parts 17 and 18 are first slid onto the shaving-head frame 12 from the side which is remote from the shaving apparatus 1, after which the two other plastics parts 19 and 20, with the shaving head 10 still detached from the shaving apparatus 1, as is shown in FIG. 5, are slid onto the two chromium-plated plastics parts 17 and 18 from the side facing the shaving apparatus 1 and are each connected by means of a pin-and-socket joint 21 and 22, respectively, in that the pins engage the sockets of the pin-and-socket joints 21 and 22. The plastics parts 17, 18 and 19, 20 may be regarded as parts of the shaving-head frame 12, which consequently comprises several parts. However, alternatively it may be constructed as a single part. The two plastics parts 19 and 20 are extended with respect to the shaving-head frame 12 in a direction towards the shaving apparatus 1. At their facing inner sides the two plastics parts 19 and 20 each have a latching nose 23 and 24, respectively, which can be retained by means of a latching hook 25 and 26, respectively. In this way the shaving head 10 is fastened to the housing 2 of the shaving apparatus 1. The latching hooks 25 and 26 are arranged on pushbuttons 27 and 28, respectively, which can be actuated by hand and which are movably supported in the housing 2 of the shaving apparatus 1, which push-buttons are both movable towards the interior of the apparatus against the force of blade springs 29 and 30, respectively, supported in the housing 2, in order to enable the shaving head 10 to be detached.

A foil frame 31 is mounted on the shaving-head frame 12 so as to be movable in the direction of an axis 32 perpendicular to an apex line of the foil-like upper cutter. The foil frame 31 can be fitted into and retained in the shaving-head frame 12 through the frame opening of the shaving-head frame 12, i.e. the frame side facing the housing 2. The foil frame 31, like the shaving-head frame 12, has a first longitudinal side wall 33, a second longitudinal side wall 34, a first transverse side wall 35 and a second transverse side wall 36. A cylindrical portion 39 and 40, respectively, is connected to each of the two transverse side walls 35 and 36 via a web 37 and 38, respectively. In FIG. 5 only the cylindrical portion 40 is shown in cross-section and in FIG. 5 only the cylindrical portion 39 is visible. The cylindrical portion 39 engages a hollow cylindrical guide chamber 41 in the first transverse side wall 15 of the shaving-head frame 12 with only little clearance. The guide chamber 41 adjoins a release slot 42, through which the web 37 is passed. The cylindrical portion 40 engages a guide chamber 43 of substantially rectangular cross-section in a second transverse side wall 16 of the shaving-head frame 12 with a comparatively large clearance in the direction of the longitudinal side walls 13, 14, 33 and 34 but only a small clearance in a direction transverse thereto, which chamber adjoins a release slot 44, through which the web 38 extends. In this way the cylindrical portions 39 and 40 and the guide chambers 41 and 43 guide the foil frame 31 relative to shaving-head frame 12 so as to be movable in the direction of the axis 32.

Figure 2:
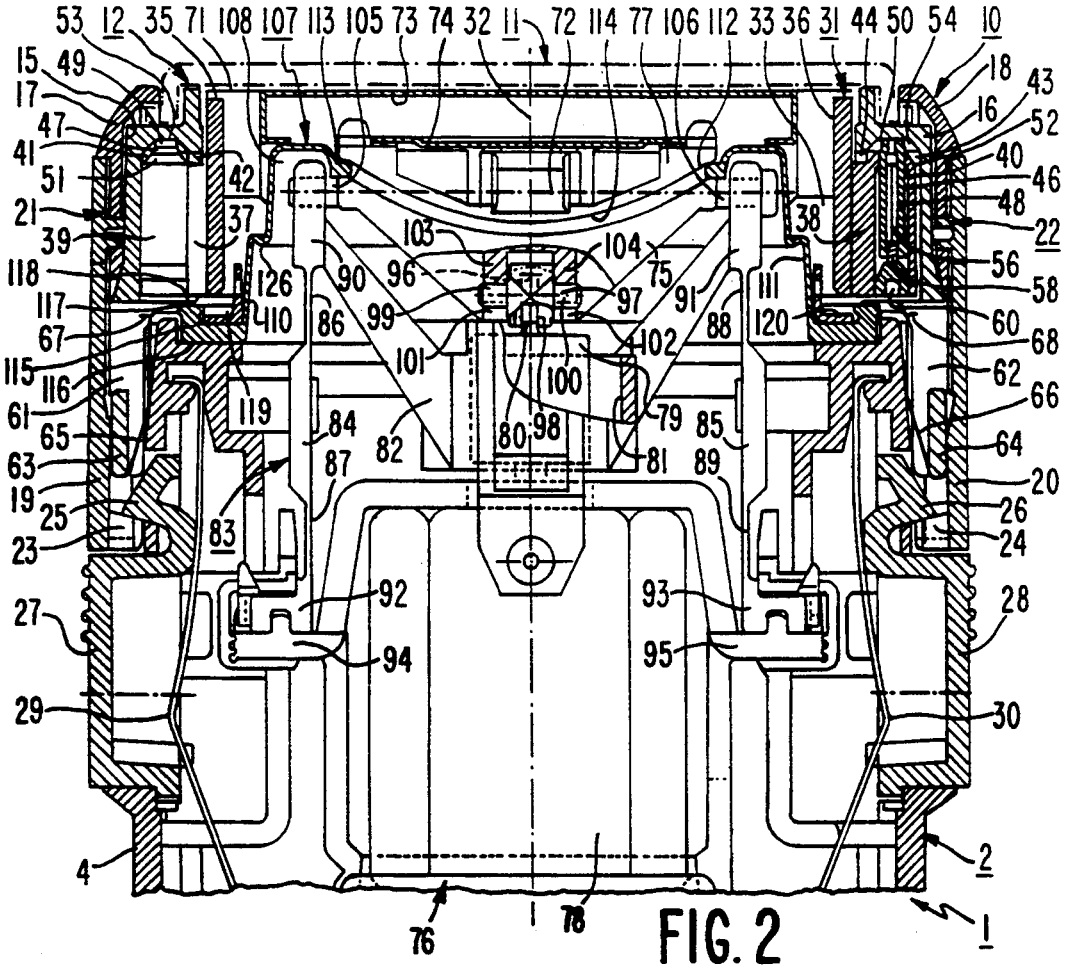
FIG. 2 is an enlarged-scale cross-sectional view showing the shaving head with a shaving-head frame and a foil frame, which is movably guided relative to the shaving-head frame, and the part of the shaving apparatus shown in FIG. 1 which is situated adjacent the shaving head and in which a dust seal is provided.
Figure 3:
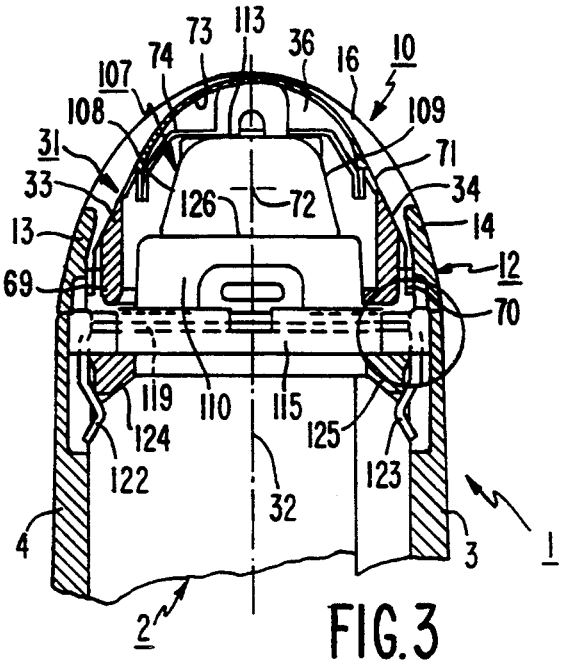
FIG. 3 is a partly sectional side view showing the shaving head and the part adjacent the shaving head of the shaving apparatus shown in FIGS. 1 and 2, the dust seal being shown in side view.

Each of the two cylindrical portions 39 and 40, as is shown for the portion 40 in FIG. 2 and for the portion 39 in FIG. 5, has a circumferentially closed hollow cylindrical duct 45, 46. Each of the ducts 45 and 46 is slidably engaged by a sleeve 47 and 48, respectively, forming a piston-like pressure member. With its substantially closed end 49, 50 each of the sleeves 47 and 48 extends from the respective duct 45 or 46 through a hole formed in the upper area 51 or 52 of the respective portion 39 or 40 and abuts against an upper bounding wall 53, 54 of the respective guide chamber 41 or 43. In each of the hollow cylindrical bores 55 and 56 of the respective sleeves 47 and 48 a helical pressure spring 57, 58 extends to the bottom of the respective sleeve 47 or 48. The end of each helical pressure spring 57 or 58 which is remote from the sleeve bottom acts against a closing member 59 or 60, which is formed by an insert pressed into the respective duct 45 or 46 to close this duct 45 or 46. In this way the two helical pressure springs 57 and 58 provide a spring load between the foil frame 31 and the shaving-head frame 12. As a result, the helical pressure springs 57 and 58 tend to move the foil frame 31 relative to the shaving-head frame 12, which is fixed to the housing 2 of the shaving apparatus 1 by the latching hooks 25 and 26, towards the shaving apparatus 1 parallel to the axis 32. This has the advantage that in the ducts 45 and 46 the helical pressure springs 57 and 58 are captively retained and protected against soiling and the helical pressure springs 57 and 58 act on the shaving-head frame 12 via the sleeves 47 and 48, the cylindrical portions 39 and 40 with the inserts 59 and 60 and the upper bounding wails 53 and 54 forming contact portions for the helical pressure springs 57 and 58 on the foil frame 31 and the shaving-head frame 12.

In order to limit the movement possibility of the foil frame 31 relative to the shaving-head frame 12, i.e. in order to hold the foil frame 31 in the shaving-head frame 12 when this frame 12 is removed from the shaving apparatus 1 and prevent it from falling out, the present shaving apparatus 1 has the following very simple and advantageous provisions. The two transverse side walls 15 and 16 of the shaving-head frame 12 are extended relative to the two transverse side walls 35 and 36 of the foil frame 31 in the direction of the housing 2 of the shaving apparatus 1 and each have a wall extension 61 and 62, respectively, which wall extensions project from the shaving-head frame 12 towards the shaving apparatus 1 and are covered by the plastics parts 19 and 20. These wall extensions 61 and 62 are substantially U-shaped and each have a bridge portion 63 and 64, respectively, connecting the two legs of the U. Blade springs 65 and 66, which extend substantially in the direction of the wall extension 61 or 62, respectively, towards the foil frame 31, are connected to the two bridge portions 63 and 64, respectively and act as positive locking devices. The two blade springs 65 and 66 serve as movable latches with whose respective free ends 67 and 68 the foil frame 31 can be retained positively in the shaving-head frame 12 in that the free ends 67 and 68 of the blade springs 65 and 66, respectively, act on the cylindrical portions 39 and 40, respectively, and on the respective closing members 59 and 60 at this location and thus take up the forces exerted by the helical pressure springs. In this way the foil frame 31 is reliably secured in the shaving-head frame 12 with simple means, the use of the blade springs 65 and 66 as the latching devices further having the advantage of a very simple mounting and removal of the foil frame 31 into and from the shaving-head frame 12. To mount the foil frame 31 it is simply inserted between the two blade springs 65 and 66, which serve as latches and which then deflect, and it is then also advantageously ensured that the sleeves 47 and 48 cooperate with the bounding walls 53 and 54 provided for this purpose. To remove the foil frame 31 the blade springs 65 and 66 are simply pressed apart by hand, after which the foil frame 31 is initially pressed out of the shaving-head frame 12 under the influence of the helical pressure springs 57 and 58 and can subsequently be pulled freely out of the shaving-head frame 12.

At its four corners the foil frame 31 has resilient tabs 69 and 70 projecting obliquely from the respective longitudinal side walls 33 and 34. These tabs 69 and 70 are integral with the foil frame 31. The tabs 69 and 70 bear against the longitudinal side wails 13 and 14 of the shaving-head frame 12, so that the clearance between the guide chambers 41 and 43 of the shaving-head frame 12 and the cylindrical portions 39 and 40 of the foil frame 31 in a direction transverse to the longitudinal side walls 13, 14 and 33, 34 is compensated for and cannot give rise to noise.

The foil frame 31 serves to hold the afore-mentioned foil-like upper cutter of the shaving head 10, which in the present case is formed by a shear foil 71 which, in a manner not shown, has two longitudinal edge portions attached to the two longitudinal side walls 33 and 34 of the foil frame 31. The shear foil 71 then assumes an arched shape relative to an axis 72 perpendicular to the axis 32, so that its area formed with hair-entry apertures constitutes a shaving area which is arched relative to the axis 72.

The shear foil 71 cooperates with a lower cutter 73, which in the present shaving apparatus 1 is of a laminar or foil-like construction, the foil thickness of the lower cutter 73 being larger than the foil thickness of the shear foil 71. The lower cutter 73 is secured to a lower-cutter support 74, to which the longitudinal edges of the lower cutter 73 are connected in a manner, not shown. The lower cutter 73 is also has an arched shape relative to the axis 72. In its central area the lower cutter also has hair-entry apertures, which central area also constitutes a shaving area which is arched relative to the axis 72.

The lower cutter support 74 together with the foil-like lower cutter 73 secured thereto is connected to a drive member 75 of a drive means 76 of the shaving apparatus 1, the lower cutter support 74 being mounted and latched onto a driving portion 77 of the drive member 75. The drive means 76 will be described briefly hereinafter. For the drive means 76 reference is made to EP 0,480,499 A1 from which a shaving apparatus 1 comprising such a drive means is known and which is herewith incorporated by reference.

The drive means 76 comprises a motor 78, whose rotatably drivable motor shaft, not shown in FIG. 2, is connected to a rotatably drivable eccentric 79 from which a pin 80 projects which is eccentric relative to the shaft of the motor 78. In the present case the eccentric 79 extends through an opening 81 in a substantially V-shaped coupling portion 82 of a reciprocating bridge 83. In addition to the V-shaped coupling portion 82 the reciprocating bridge comprises two legs 84 and 85, each of which have two integral-hinge portions 86, 87 and 88, 89, respectively, and which are each connected to the V-shaped coupling portion 82 by a connecting portion 90 and 91, respectively, adjoining the integral-hinge portions 86 and 88, respectively, and which are secured to a stationary mounting portion 94 and 95, respectively, of the apparatus by a fixing portion 92 and 93, respectively, connected to the other integral-hinge portions 87 and 89, respectively.

The eccentric pin 80 of the eccentric 79 projects into a bore 96 in a transmission member 98 having a cylindrical shape relative to an axis 97 parallel to the axis 72 from which two cylindrical projections 99 and 100 project laterally, which projections are coaxial with the axis 97. These projections 99 and 100 engage two slots 101 and 102 which are open towards the eccentric 79 and which have two tabs 103 and 104 projecting from the drive member 75. The drive member 75, which can be driven by the eccentric pin 80 via the transmission member 98, has two cylindrical lateral projections 105 and 106 which are coaxial with the axis 72 and which are rotatable or pivotable in two slots in the connecting portions 90 and 91, which slots are open towards the lower cutter 73.

The legs 84 and 85 of the reciprocating bridge 83 are stiff in the direction of the axis 32, so that the drive member 75, which is pivotably supported in the connecting portions 90 and 91 and the lower cutter 73 connected to the drive member 75 via the lower cutter support 74 can perform little or no movement in the direction of the axis 32. However, the legs 84 and 85 are highly flexible in the direction of the axis 72, allowing the lower cutter 73 to perform a reciprocating oscillatory movement parallel to the axis 72. In the present shaving apparatus 1, in addition to this reciprocating movement of the lower cutter 73, a swinging movement about the axis 72 is imparted to the lower cutter 73 via the drive means 76 described above, which swinging movement is superposed on the reciprocating movement parallel to the axis 72, so that in the present shaving apparatus 1 the lower cutter 73 performs a combined movement consisting of a linear reciprocating movement and a swinging movement.

Thus, in the present shaving apparatus 1 the lower cutter 73 is supported stiffly in the direction of the axis 32. The shear foil 71 is pressed against the lower cutter 73 thus supported in that the shear foil 71, which is secured to the foil frame 31, is loaded by the helical pressure springs 57 and 58, which bear against the shaving-head frame 12 via the sleeves 47 and 48. In this way, the shear foil 71 in the present shaving apparatus 1 is spring-loaded relative to the lower cutter 73, which is also of a substantially foil-like construction. This spring load ensures that the shear foil 71 and the foil-like lower cutter always interengage correctly, which guarantees a satisfactory shaving performance and shaving quality, the shaving performance of the shaving apparatus 1 being very high owing to the combined movement of the lower cutter 73.

Figure 6:
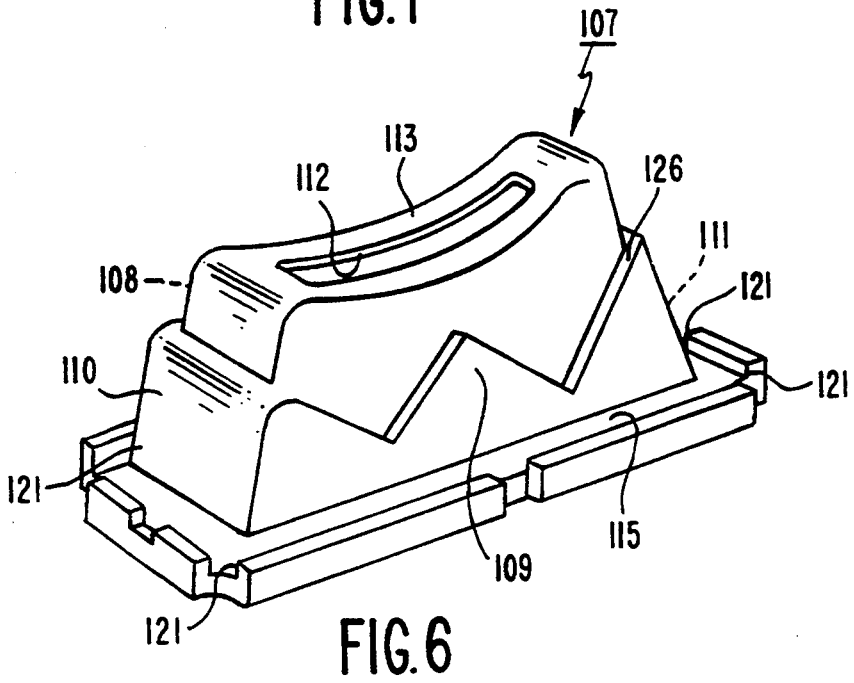
FIG. 6 is an oblique view showing the dust seal of the shaving apparatus shown in FIGS. 1, 2 and 3.

In order to preclude the entry of shaving particles into the drive means 76 in the shaving apparatus 1 the shaving apparatus 1 has a dust seal 107. The dust seal 107 is made of an elastic material, i.e. of rubber. The dust seal has a hood-like and trough-like shape and is arranged around the block-shaped drive member 75. As is as shown in FIGS. 2, 3 and 6 the dust seal 107 has four side walls 108, 109, 110 and 111. The dust seal 107 further has an end portion 113 connecting the dust seal 107 to the drive member 75, which end portion bounds the four side walls 108, 109, 110 and 111 at their ends facing the lower cutter 73 and which has an opening 112 for the passage of the driving portion 77 of the drive member 75. For this purpose the drive member 75 has a continuous circumferential groove 114 in which the dust seal 107 engages with its wall portions bounding the opening 112 in the end portion 113. The dust seal 107 further has a peripheral portion 115 with which the dust seal 107 engages against a stationary zone of the housing, which peripheral portion bounds the four side walls 108, 109, 110 and 111 at their ends which are remote from the lower cutter 73.

Figure 4:
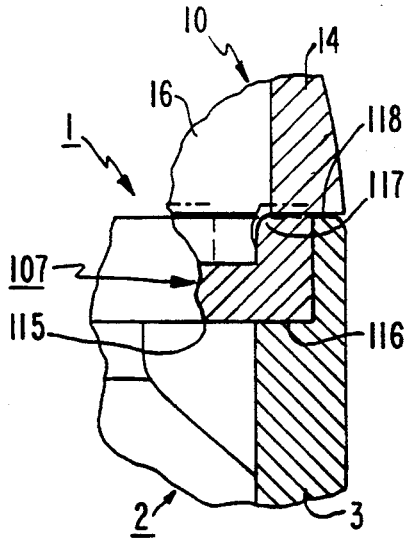
FIG. 4 shows a part, encircled in FIG. 3, of the shaving apparatus in FIGS. 1, 2 and 3 to an enlarged scale in comparison with FIG. 3.

As is shown in FIG. 4, the peripheral portion 115 of the dust seal 107 engages a step 116 which is formed inside the housing and which is open towards the shaving head 10. Moreover, the dimension of the peripheral portion 115 in the height direction of the step 116 is selected in such a manner that the peripheral portion 115 of the dust seal 107 presses against an area 118 of the shaving head 10 and its shaving-head frame 12 at a peripheral zone 117 which is free from the step 116. This prevents mechanical vibrations between the housing 2 of the shaving apparatus 1 and the shaving head 10 and its shaving-head frame 12, so that such vibrations cannot give rise to noise and a silently operating shaving apparatus is obtained. The dust seal 107 is secured in the shaving apparatus 1 by means of two resilient clips 119 and 120. The resilient clips 119 and 120 are passed through recesses 121 at the comers of the peripheral portion 115 of the dust seal 107 and are clamped to ridges 124 and 125 on the housing with their bent end portions 122 and 123.

As can be seen in FIG. 6, the dust seal 107 has a shoulder 126 which extends over all four side walls 108, 109, 110 and 111. In the present shaving apparatus 1 this shoulder 126 has an undulating shape at the two facing side walls 108 and 109 which extend parallel to the direction of the axis 72. As is shown, the undulating portions of the shoulder 126 are sawtooth-shaped. However, the undulating portion may also have a substantially sinusoidal shape. If desired, the shoulder 126 may also have an undulating shape at the two shorter side walls 110 and 111. The provision of the shoulder 126 with an undulating shape ensures that the wall portions of the large side walls 108 and 109 which are separated from each other by the shoulder 126 with an undulating shape can perform almost only movements parallel to these wall portions, so that these side walls 108 and 109 of the dust seal 107 do not act as an acoustic diaphragm. Thus, it is achieved that the dust seal 107 produces only very little noise, which is also advantageous in order to realize a very silent shaving apparatus with such a dust seal.

The invention is not limited to the exemplary embodiment described hereinbefore. The invention can also be employed in a shaving apparatus in which the lower cutter does not perform a combined reciprocating movement and swinging movement but merely a pure reciprocating movement. Moreover, other shapes of dust seals are possible, for example a dust seal whose entire shoulder has an undulating shape. Likewise, such a dust seal may comprise two such shoulders arranged opposite one another.

I claim:

1. A shaving apparatus comprising a shaving head (1) having a foil-like upper cutter (71) and a lower cutter (73) engaging with said upper cutter (71), said cutters both having a shaving area which is arched relative to an axis (72), a drive means (76) for said lower cutter (73), said drive means (76) being driveable by a motor (78) and comprising a block-shaped drive member (75) adapted to impart to said lower cutter (73) at least a movement parallel to said axis (72), and a dust seal (107) of an elastic material, said dust seal (107) having a hood-like and trough-like shape and arranged around said block-shaped drive member (75) and comprising four side walls (108, 109, 110 and 111) and an end portion (113) connecting said dust seal (107) to said drive member (75), said end portion (113) bounding said four side walls (108, 109, 110 and 111) at side wall ends facing said lower cutter (73) and having an opening (112) for passage of a driving portion (77) of the drive member (75), and a peripheral portion (115) for engaging said dust seal (107) against a stationary zone of a housing (2), said peripheral portion (115) bounding said four side walls (108, 109, 110 and 111) at side wall ends remote from said lower cutter (73), characterized in that said dust seal (107) has a shoulder (126) which extends over all of said four side walls (108, 109, 110 and 111) and said shoulder has an undulating shape extending in a direction parallel to said axis (72) at least at two facing side walls (108 and 109) which extend parallel to said axis (72).

2. A shaving apparatus as claimed in claim 1, characterized in that the shoulder (126) is sawtooth-shaped at least at said two facing side walls (108 and 109).

3. A shaving apparatus as claimed in claim 2, wherein the peripheral portion (115) of the dust seal (107) engages a step (116) which is formed inside the housing and which is open towards the shaving head (10), and the peripheral portion (115) of the dust seal (107) presses against an area (118) of the shaving head (10) with a peripheral zone (117) which is free from the step (116).

4. A shaving apparatus as claimed in claim 1, characterized in that the peripheral portion (115) of the dust seal (107) engages a step (116) which is formed inside the housing and which is open towards the shaving head (10), and the peripheral portion (115) of the dust seal (107) presses against an area (118) of the shaving head (10) with a peripheral zone (117) which is free from the step (116).

* * * * *